United States Patent [19]

Thomson

[11] Patent Number: 4,739,246

[45] Date of Patent: Apr. 19, 1988

[54] CURRENT REFERENCE FOR FEEDBACK CURRENT SOURCE

[75] Inventor: Robert G. Thomson, Tempe, Ariz.

[73] Assignee: GTE Communication Systems Corporation, Phoenix, Ariz.

[21] Appl. No.: 56,499

[22] Filed: Jun. 1, 1987

[51] Int. Cl.[4] ..... G05F 1/575; G05F 3/26

[52] U.S. Cl. ..... 323/273; 323/316

[58] Field of Search ..... 323/273, 315, 316; 330/288

[56] References Cited

U.S. PATENT DOCUMENTS

| | | | |
|---|---|---|---|
| 3,962,592 | 6/1976 | Thommen et al. | 323/315 |
| 4,329,639 | 5/1982 | Davis | 323/315 |
| 4,435,678 | 3/1984 | Joseph et al. | 323/281 |
| 4,500,831 | 2/1985 | Akram | 323/315 |
| 4,528,496 | 7/1985 | Naokawa et al. | 323/316 |

FOREIGN PATENT DOCUMENTS

| | | | |
|---|---|---|---|
| 68946 | 6/1977 | Japan | 323/315 |
| 191629 | 10/1984 | Japan | 323/316 |
| 17519 | 1/1985 | Japan | 323/315 |
| 80307 | 5/1985 | Japan | 330/288 |
| 16312 | 1/1986 | Japan . | |

*Primary Examiner*—William H. Beha, Jr.
*Attorney, Agent, or Firm*—John A. Odozynski; Peter Xiarhos

[57] ABSTRACT

A Current Reference for providing a feedback signal to a current driver in a current-series, feedback-controlled current source circuit that includes at least one, but more likely more than one, controlled current source. The Current Reference comprises a current mirror having an input transistor coupled to an output transistor in a current mirror configuration. The input transistor of the current mirror is driven by a constant current source, Icc, so that the current mirror output transistor causes a current substantially equal to Icc to flow out of a summing node. A sensing transistor is coupled to a controlled current source for providing a current into the summing node that is representative of the current delivered by the controlled current source. As a result, the current flowing away from the summing node and into a phase inverter is representative of the difference between the delivered current and Icc. The output of the phase inverter is coupled to the current driver so as to maintain the magnitude of the delivered current at the intended value.

10 Claims, 1 Drawing Sheet

CURRENT REFERENCE FOR FEEDBACK CURRENT SOURCE

CROSS REFERENCE TO RELATED APPLICATIONS

Cross-Reference is made to the following related patent applications, all assigned to the same assignee as is this application:

Application Ser. No. 783,995, "Differential Amplifier Feedback Current Mirror," filed Oct. 4, 1985, now U.S. Pat. No. 4,700,144.

Application Ser. No. 784,065, "Impedance Maintenance Circuit for Telephone Interface," filed Oct. 4, 1985, now U.S. Pat. No. 4,683,351.

Application Ser. No. 784,085, "Nonsaturating Interface Supply," filed Oct. 4, 1985.

TECHNICAL FIELD

This invention relates to integrated circuit design techniques and, more particularly, to a current reference for a feedback current source configuration that minimizes offsets derived from base drive requirements.

BACKGROUND OF THE INVENTION

The current mirror circuit configuration has found widespread use as an integrated circuit design technique and its operation is well known to practitioners in the art. In a canonical form as depicted in FIG. 1, the current mirror includes a current drive transistor, shown as Q1 in FIG. 1, whose current I1 is externally fixed or forced in some manner, for example, through the use of a constant current source. The base of Q1 is then attached to a string of controlled current sources Q2, . . . , Qn. If transistors Q1, . . . , Qn are fabricated from a monolithic piece of semiconductor material, then their Vbe and emitter-current characteristics will match. And, if R1=R2=. . .=Rn and if the current source base-emitter areas are of the same size, then I1=I2=. . .=In. It is also understood that the emitter resistors and emitter areas may be "ratioed" so that the controlled currents, I2, . . . , In, may be set at a predetermined fixed multiple or fixed fraction of I1.

However, in any event it may be seen that the base current of Q1 and, therefore, I1 contain a current component attributable to the sum of the base currents of I2, . . . , In. If the string of controlled current sources is long (n large) or if the beta's of the transistors are low, as would likely be the case were these devices laterally diffused transistors, then the base drive component of I1 will become large. In this case the assumption I1=I2=. . .=In is no longer valid, and the current delivered by the controlled current sources will deviate from the predetermined predicted current.

The thrust of the subject invention is a technique for eliminating this error. With reference to FIG. 1, the technique can be understood as a departure according to which I2, or some other controlled current source, is compared in a feedback loop to the predetermined intended current. Deviations in the value of I2 from the intended value cause an error signal to be developed. The error signal is then used to adjust the drive to the current drive transistor Q1 so that the value of I2, as well as the values of the other controlled current sources in the string, are forced back toward the intended value.

A similar technique appears in U.S. Pat. No. 4,435,678, "Low Voltage Precision Current Source" to Joseph, et al. ("Joseph"), which discloses a current source that utilizes feedback techniques in order to mitigate the effects of power supply ripple. However, the feedback mechanism disclosed in Joseph differs markedly from the Current Reference disclosed herein in that Joseph relies on two complementary current mirror circuits (14 and 16) to establish the quiescent operating point of the current source and to provide ripple rejection to variations in the power supply voltage. Specifically, the current provided by Joseph's current source is replicated by both matched transistors in Joseph's current mirror 14. The collector currents of the two transistors are coupled to the respective collectors of a second current mirror 16. However, the current densities of those transistors are caused to have a ratio of 1:N. In addition, because a resistor 32 is connected in series with the emitter of one of the transistors, the current flowing from collector to emitter of that transistor will determine the base-to-emitter voltage applied to the other current mirror transistor 28. As the base-to-emitter voltage of Joseph's transistor 28 varies, so will its collector-to-emitter current and, therefore, the current drawn by a current sink 36 coupled to the current driver 22. As will be made clear below, the subject invention provides a distinctly different mechanism that consequently operates in a distinctly different manner.

DISCLOSURE OF THE INVENTION

The above and other objects, advantages and capabilities are achieved in one aspect of the invention by a Current Reference for a feedback-controlled current source that includes a current driver for providing drive current to a controlled current source, a current source bus for coupling the current driver to a controlled current source, and a current sink coupled to the current driver for providing drive current to the current driver. The Current Reference is coupled to the current sink and, via the current source bus, to both the current driver and to the controlled current source. The Current Reference comprises a constant current source, the value of which substantially determines the value of the current delivered by a controlled current source, and comprises first, second, and third transistors coupled together in a current mirror configuration and coupled to the constant current source so that the constant current source provides base current to the first and second transistors. The Current Reference senses the current delivered by the current source and develops a correction signal in response to deviations in the delivered current from a predetermined intended current.

Specifically, the Current Reference is so arranged and constructed that deviations in the current delivered by the controlled current sources from predetermined values are reflected in the current delivered by the Current Reference to the current sink. As a result, current-series feedback applied to the current sink modifies the current sink transconductance so that base drive to the current driver and, hence, drive to the the controlled current sources are appropriately adjusted. This technique eliminates errors that otherwise occur in the standard current mirror configuration. To wit: Negative feedback from the Current Reference modulates the base drive to the controlled current source that can accumulate in the current driver and would cause any offset between the current actually delivered by the controlled current sources and the intended current.

DESCRIPTION OF A PREFERRED EMBODIMENT

For a comprehensive understanding of the subject Current Reference, attention is directed to the following description and appended claims in conjunction with the above-described drawings.

Figure 1:
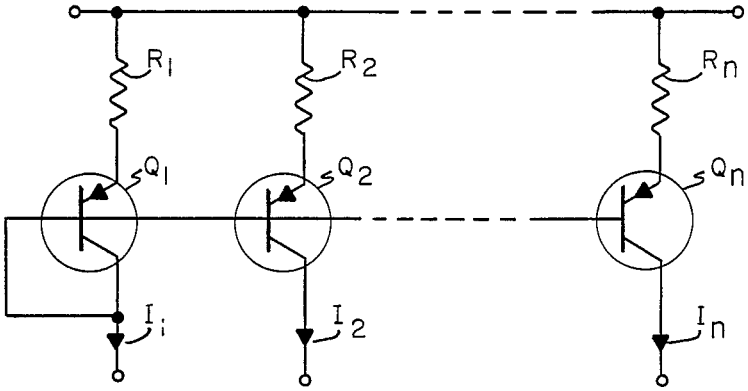
FIG. 1 (PRIOR ART)
FIG. 1 illustrates the canonical form of the standard current mirror circuit configuration.
Figure 2:
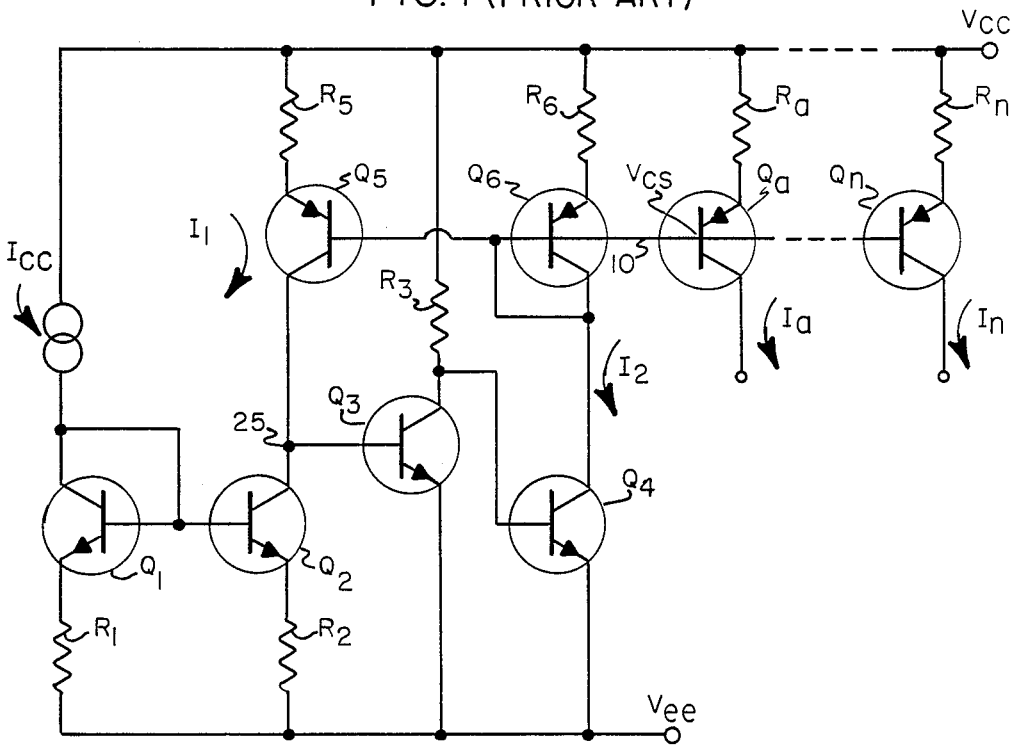
FIG. 2 is a detailed schematic diagram of the subject Current-Series Feedback Current Mirror.

Referring now to FIG. 2, depicted therein is a current-series feedback current source that includes a current driver, in the form of a transistor Q6, for providing bias and base current to a string of controlled current sources Qa, . . . , Qn. Q6 has an emitter coupled through a resistor R6 to a first voltage supply Vcc. The base of Q6 is coupled to the controlled current sources via a current source bus 10 so that the voltage, Vcs, at the bases of the controlled current sources is equal to the voltage at the base of Q6. Q6 provides both bias voltage and base current drive to those devices. Base drive to Q6 itself is provided by a current sink, Q4. Q4 has a collector coupled in common to both the base and the emitter of Q6 and an emitter coupled to a second voltage supply, Vee.

The current source circuit also includes a Current Reference that includes first, second and third transistors Q1, Q2 and Q5, respectively, and a constant current source, Icc. Icc is coupled between Vcc and the bases of Q1 and Q2, which transistors are themselves arranged in a current mirror configuration. That is, the base of Q1 is coupled to the base of Q2, and the respective emitters of Q1 and Q2 are coupled to Vee through resistors R1 and R2. Q2 collector is coupled to the collector of transistor Q5 at a summing node 25. Q5 in turn is coupled at its base to the current source bus and is coupled through resistor R5 to Vcc.

The output of the current mirror (Q1, Q2), at the collector of Q2, is coupled to the input of a phase inverter comprising transistor Q3. Q3 has a base coupled at summing node 25 to the collector of Q2, an emitter coupled to Vee, and a collector coupled through resistor R3 to Vcc.

Operation of the current-series, feedback current source is as follows. Constant current source Icc forces a current, substantially equal to Icc, to flow in the collector-to-emitter path of Q1. The (Q1, Q2) current mirror configuration dictates that the emitter current of Q2 be equal to the emitter current of Q1, that is, Icc. With the simplifying assumption that Q2 collector and emitter currents are equal, it can be seen that the current flowing away from summing node 25 and into the input of phase inverter Q3 is equal to I1 less Icc, where I1 is the collector current of Q5. However, Q5 is coupled by the current bus to controlled current sources Qa, . . . , Qn so that the current flowing in Q5 accurately reflects the current flowing in the controlled current sources. It should be noted that in practice the emitter resistors, Ra, . . . , Rn, of the controlled current sources may be "ratioed" to R5 and their respective emitter areas ratioed to the emitter area of Q5 so that Q5 emitter current is, if desired, a predetermined multiple or fraction of the controlled current source emitter currents.

Ideally, the drive current provided by Q6 to the controlled current sources will be such that I1 will equal Icc and equilibrium will exist. As can be seen from the drawing, the base drive currents for Q5 and for the controlled current sources accumulate in Q6 base current. Should Q6 base current become large, a material offset will exist in the bias provided via the current source bus to the controlled current sources. This offset will directly cause a deviation in the value of the current delivered by the controlled current sources from the predetermined desired values. However, the current mirror is configured to operate in a negative-feedback mode so as to circumvent the effects attributable to the Q6 base current component.

Specifically, as Q6 base current becomes large, its emitter current will increase, thereby causing excessive voltage drops across Ra, . . . , Rn, the controlled current source emitter resistors, and causing excessive delivered currents Ia, . . . , In. However, because Q5 is in effect mirrored to the controlled current sources, I1 will increase concomitantly. Because Q2 collector current is clamped at Icc, the base drive to the input of phase inverter Q3 must necessarily increase. As this occurs the voltage drop across R3 will increase, reducing the voltage at the base of current sink Q4. Transconductance effects will operate to reduce Q4 collector current and, hence, reduce the base drive to the current driver Q6. The base drive to the controlled current sources will then be reduced accordingly so that the necessary correction is effected.

To summarize, the current delivered by the string of controlled current sources is sensed by Q5 in the Current Reference. The current detected by Q5 is combined with the current developed by the current mirror at the collector of Q2 so that an error signal, related to the difference between the detected current and constant current, Icc, is developed at summing node 25. This error is phase inverted by Q3 so that current-series feedback developed across R3 appropriately adjusts the transconductance of Q4 and, hence, the drive provided to current driver Q6. Accordingly, although there has been shown and described what at present is considered to be a preferred embodiment of a current-series feedback-controlled current mirrors, it will be obvious to those having ordinary skill in the art that various changes and modifications may be made therein without departure from the scope of the invention as defined by the appended claims.

What is claimed is:

1. In feedback-controlled current source that comprises a current driver for providing drive current to a controlled current source, a current source bus for coupling the current driver to the controlled current source, and a current sink coupled to the current driver for providing drive current to the current driver, a Current Reference coupled to the current sink and coupled via the current source bus to both the current driver and to the controlled current source, said Current Reference for sensing the current delivered by the current source and for developing a correction signal in response to deviations in the delivered current from a predetermined intended current and comprising:

a constant current source, the value of which substantially determines the value of the current delivered by the controlled current source, and first, second, and third transistors coupled together in a current mirror configuration and coupled to the constant current source so that the constant current source provides base current to those first and second transistors.

2. In feedback-controlled current source, a Current Reference as defined in claim 1 wherein the third transistor of the Current Reference is coupled at one electrode to the current source bus and at another electrode to the second transistor of the Current Reference so that the third transistor develops a reference current substantially reflecting the current delivered by a controlled current source and so that a difference between the value of the reference current and the value of the current provided by the constant current source is coupled to the current sink in a negative-feedback fashion so as to appropriately adjust the drive current provided to the current driver.

3. In a feedback-controlled current source, a Current Reference as defined in claim 2, further comprising a phase inverter coupled to the current sink.

4. In a feedback-controlled current source, a Current Reference as defined in claim 3 wherein the phase inverter comprises a transistor having an input electrode coupled to the second transistor of the current mirror configuration and an output electrode coupled to the current sink so that, as the current delivered by a controlled current source increases, the current provided to the transistor increases, the drive provided to the current sink decreases, and the current drive provided to the current driver decreases.

5. In a feedback-controlled current source, a Current Reference as defined in claim 4 wherein the first and second transistors of the current mirror configuration are of the same conductivity type and are of a conductivity type opposite to that of the third transistor.

6. In a feedback-controlled current source, a Reference Current Source as defined in claim 5 wherein the first and second transistor of the current mirror configuration are NPN transistors.

7. In a current-series, feedback-controlled current source comprising a current driver (Q6) for providing drive current and bias to a string pf controlled current sources (Qa, . . . , Qn), a current bus for coupling the current driver to the string of controlled current sources, and a current sink (Q4) for providing drive current to the current driver, a Current Reference comprising:

a feedback current source (Q5) coupled to the current bus, to the current driver, and to the string of controlled current sources for detecting the current delivered by the controlled current sources and for generating a feedback current in proportion thereto;

a constant current source;

a summing transistor (Q2) having an input coupled to the constant current source and an output coupled to the feedback current source for providing a current at its output substantially equivalent to the difference between the value of the constant current source and the value of the feedback current; and a phase inverter coupling the output of the summing transistor to the current sink so that deviations of the current delivered by the controlled current source from a predetermined intended value result in an adjustment of the drive current provided by the current sink to the current driver.

8. In a feedback-controlled current source, a Current Reference as defined in claim 7 wherein the constant current source is coupled to a pair of transistors, including the summing transistor, that are arranged in a current mirror configuration so that the current flowing in the collector of the summing transistor is substantially equal to the value of the constant current source.

9. A Current Reference for providing a feedback signal to a current driver (Q6) in a current-series, feedback-controlled current source circuit that includes a controlled current source, the Current Reference comprising:

a current mirror having an input transistor (Q1) coupled to an output transistor (Q2) in a current-mirror configuration;

a constant current source coupled to the input transistor of the constant current source;

a summing node coupled to the output transistor of the current mirror;

a sensing transistor (Q5) coupled to the controlled current source and to the summing node for sensing the current delivered by the controlled current source and for providing a current at the summing node indicative of the delivered current so, that the current out of the summing node is representative of the difference between the delivered current and the magnitude of the constant current source; and a phase inverter (Q3) coupled to the summing node and coupled to the current driver so that the drive provided to the current source varies inversely with the amplitude of the current out of the summing node.

10. A Current Reference as defined in claim 9 wherein the phase inverter comprises a phase inverter transistor (Q3) arranged in a common-emitter configuration with a resistive collector load and wherein the phase inverter transistor is coupled to the current source via a current sink so that, as the current leaving the summing node increases, the voltage at the collector of the phase inverter transistor decreases, and the current conducted by the current sink decreases.

* * * * *